United States Patent [19]

Hart et al.

[11] 4,313,541

[45] Feb. 2, 1982

[54] CARTON WITH ARTICLE RETAINING STRUCTURE

[75] Inventors: Joseph J. Hart; John D. Desmond, both of Philadelphia, Pa.

[73] Assignee: Container Corporation of America, Chicago, Ill.

[21] Appl. No.: 170,895

[22] Filed: Jul. 21, 1980

[51] Int. Cl.[3] ..... B65D 5/06; B65D 85/30

[52] U.S. Cl. ..... 206/588; 206/45.14; 206/491; 220/445

[58] Field of Search ..... 206/588, 591, 592, 521, 206/491, 321, 45.14, 45.19; 229/40, 34 HW, 39 R; 220/445, 446, 447

[56] References Cited

U.S. PATENT DOCUMENTS

| | | | |
|---|---|---|---|
| 2,738,055 | 3/1956 | Shanahan | 229/40 |
| 3,326,362 | 6/1967 | Smith et al. | 206/321 |
| 3,411,696 | 11/1968 | Ayer et al. | 206/491 |
| 3,521,812 | 7/1970 | Moers et al. | 229/39 R |
| 3,866,745 | 2/1975 | Dlugopolski | 229/34 HW |

*Primary Examiner*—William T. Dixson, Jr.
*Attorney, Agent, or Firm*—R. W. Carpenter; Davis Chin

[57] ABSTRACT

A paperboard carton having integral internal structure for retaining a packaged article in a fixed position.

2 Claims, 4 Drawing Figures

CARTON WITH ARTICLE RETAINING STRUCTURE

SUMMARY OF THE INVENTION

The invention relates to folding cartons of the type used for the packaging of articles such as filled trays having flanges projecting laterally outward from upper portions thereof.

In packaging bakery type items such as cakes which are contained on pads or in trays, it is essential to the protection of the packaged article that the tray be maintained in a fixed position against one wall, such as the bottom wall, of the carton.

It is therefore an object of the present invention to provide a folding carton formed from a unitary blank of foldable sheet material, such as paperboard, which includes an integral structure for engaging a portion of the packaged article and holding it against the bottom wall of the carton.

These and other objects of the invention will become apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 4:
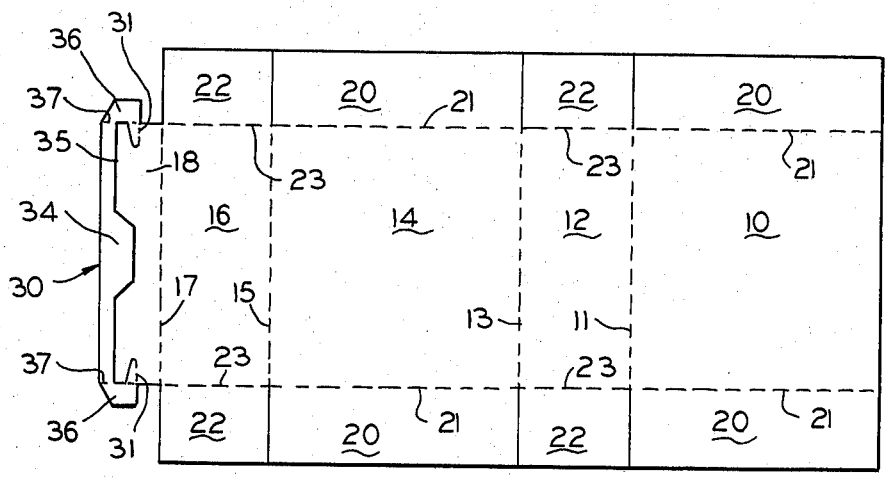
FIG. 4 is a plan view of the blank of sheet material from which the carton illustrated in the other views may be formed.
Figure 1:
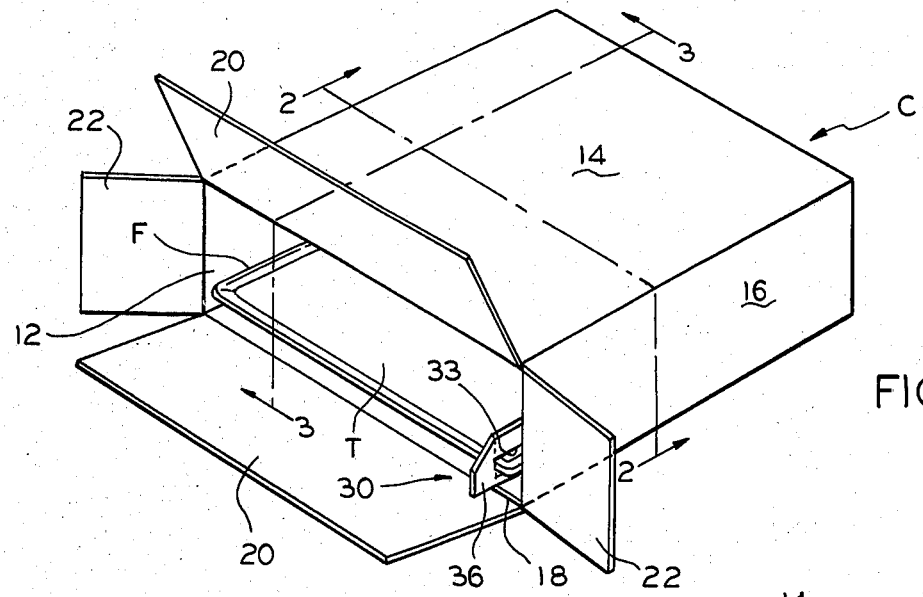
FIG. 1 is a perspective view of a carton embodying the invention, as seen with a packaged article in position therewithin.
Figure 2:
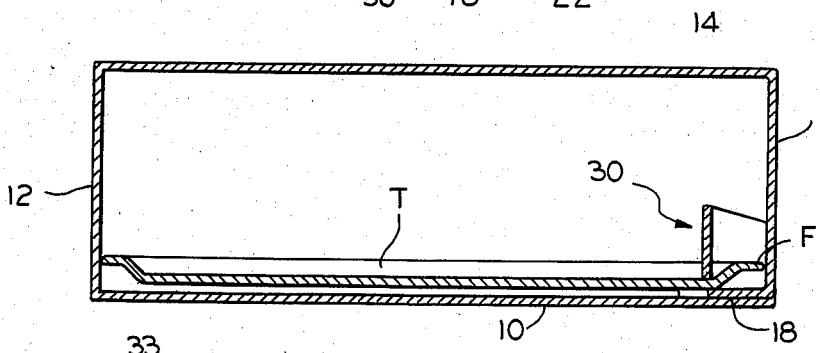
FIG. 2 is a vertical section taken on line 2—2 of FIG. 1.
Figure 3:
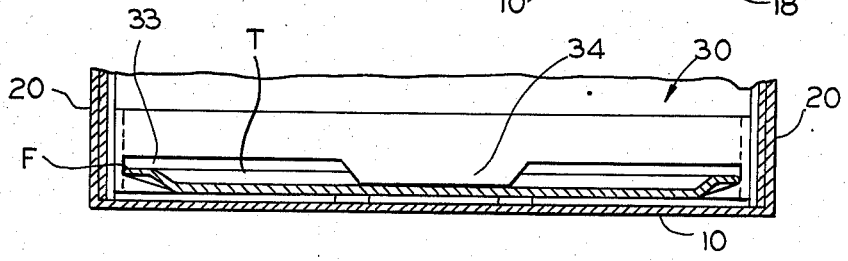
FIG. 3 is a vertical section taken on line 3—3 of FIG. 1.

Referring now to the drawings for a better understanding of the invention, it will be seen that the carton C illustrated in FIGS. 1–3 may be formed from a unitary blank B of foldable sheet material, such as paperboard, illustrated in FIG. 4.

As best seen in FIG. 4, the body of the carton includes a bottom wall 10, a first side wall 12, a top wall 14, a second side wall 16, and a glue flap 18, which are foldably joined to each other along parallel fold lines 11, 13, 15, and 17, respectively.

Opposed pairs of major end wall panels 20 are foldably joined to opposite ends of top and bottom walls 10 and 14 along fold lines 21 and opposed pairs of minor end wall panels 22 are foldably joined along fold lines 23 to opposite ends of side walls 12 and 16.

A retaining panel 30 is foldably joined adjacent its end portions on spaced fold lines 31 to glue flap 18.

Retaining panel 30 includes an opening 33 which is designed by a cut line 35. Cut line 35 is irregular in shape and also defines a lock tab 34 which projects into opening 33 when the carton is folded into erected condition, as shown in FIG. 3.

A pair of end flaps 36 are foldably joined along fold lines 37 to opposite ends of retaining panel 30. In the preferred form the carton is adapted to enclose a relatively shallow pad or tray T having an outwardly and upwardly extending peripheral flange F.

When the carton is in erected condition as shown in FIGS. 1–3, the retaining panel 30 projects upwardly from the bottom wall and glue flap 18 which is secured to the bottom wall 10. The retaining panel is disposed parallel to but spaced inwardly from the adjacent side wall 16, a slight distance. Thus, when the tray is inserted into the carton, the outer portions or flange F of the tray on at least one side thereof are received within the opening 33 of the retaining panel and the lock tab 34 is disposed to extend downwardly against the upper portion of the tray to thereby maintain the tray in fixed position against the bottom wall of the carton. End flaps 36 are folded inwardly at right angles to retaining panel 30 so as to lie against the inner surfaces of minor end panels or dust flaps 22 when the carton is closed.

If it is desired to use the carton for the packaging of a deeper tray, the carton can be reversed with the retaining panel 30 disposed adjacent the upper wall of the carton.

We claim:

1. A carton, formed of a unitary blank of foldable paperboard, including integral structure for holding, in a fixed position against one wall of the carton, a tray having a flange projecting laterally outward from an upper portion thereof, said carton comprising:

(a) a pair of opposed top and bottom horizontal walls;

(b) opposed pairs of side and end vertical walls foldably joined to each other on first fold lines and to said horizontal walls on second fold lines, which extend normal to said first fold lines, to define a box-like enclosure;

(c) a glue flap foldably joined to one of said opposed top and bottom walls;

(d) a retaining panel foldably joined to said glue flap and extending parallel to but spaced inwardly to one of said pairs of side walls, said retaining panel having a laterally extending opening to receive a portion of the outer flange of a tray and a lock tab extending downwardly against the upper portion of the tray at a right angle to said horizontal walls to hold said tray in a fixed position against said bottom wall.

2. A carton according to claim 1, wherein said retaining panel has foldably joined to its opposite ends a pair of flaps folded inwardly at right angles to said retaining panel.

* * * * *